US011355845B2

(12) United States Patent
Wu et al.

(10) Patent No.: US 11,355,845 B2
(45) Date of Patent: Jun. 7, 2022

(54) ANTENNA STRUCTURE AND COMMUNICATION DEVICE

(71) Applicant: PEGATRON CORPORATION, Taipei (TW)

(72) Inventors: Chien-Yi Wu, Taipei (TW); Hau Yuen Tan, Taipei (TW); Chao-Hsu Wu, Taipei (TW); Yi-Ru Yang, Taipei (TW); Shih-Keng Huang, Taipei (TW); I-Shu Lee, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 99 days.

(21) Appl. No.: 16/994,402

(22) Filed: Aug. 14, 2020

(65) Prior Publication Data

US 2021/0098878 A1 Apr. 1, 2021

(30) Foreign Application Priority Data

Oct. 1, 2019 (TW) ..... 108135553

(51) Int. Cl.
*H01Q 5/357* (2015.01)
*H01Q 13/10* (2006.01)
*H01Q 11/14* (2006.01)

(52) U.S. Cl.
CPC ..... *H01Q 5/357* (2015.01); *H01Q 11/14* (2013.01); *H01Q 13/106* (2013.01)

(58) Field of Classification Search
CPC ..... H01Q 5/357; H01Q 11/14; H01Q 13/106
See application file for complete search history.

(56) References Cited

U.S. PATENT DOCUMENTS

| | | | | |
|---|---|---|---|---|
| 9,608,331 | B1 * | 3/2017 | Rowson | H01Q 9/0442 |
| 2011/0275333 | A1 | 11/2011 | Kim et al. | |
| 2018/0342791 | A1 * | 11/2018 | Wu | H01Q 5/314 |
| 2019/0123423 | A1 * | 4/2019 | Wu | H01Q 1/48 |

FOREIGN PATENT DOCUMENTS

| | | |
|---|---|---|
| CN | 109687148 | 4/2019 |
| TW | 201503488 | 1/2015 |
| TW | I637561 | 10/2018 |

* cited by examiner

*Primary Examiner* — Andrea Lindgren Baltzell
*Assistant Examiner* — Amal Patel
(74) *Attorney, Agent, or Firm* — J.C. Patents

(57) ABSTRACT

An antenna structure includes a first main radiator, a second main radiator and a frequency adjustment radiator. The first main radiator is adapted to resonate in a first frequency band and a second frequency band, and includes a first section, a second section, a third section and a fourth section sequentially connected. The first section has a feed-in end, and the fourth section has a grounding end. The second section and the third section is connected in bent manner, a first slit is provided between the second section and the third section for adjusting impedance matching of the second frequency band. The second main radiator extending from the feed-in end is adapted to resonate in third frequency band and a fourth frequency band. The frequency adjustment radiator is connected to the third section and is adapted to adjust a resonant frequency point of the first frequency band.

13 Claims, 9 Drawing Sheets

ANTENNA STRUCTURE AND COMMUNICATION DEVICE

CROSS-REFERENCE TO RELATED APPLICATION

This application claims the priority benefit of Taiwan application serial no. 108135553, filed on Oct. 1, 2019. The entirety of the above-mentioned patent application is hereby incorporated by reference herein and made a part of this specification.

BACKGROUND

Technical Field

The disclosure relates to an antenna structure and a communication device, and particularly relates to an antenna structure with multiple frequency bands and a communication device.

Description of Related Art

Sub 6-GHz is a mainstream frequency band in 5G communication. In addition to frequency bands from 698 MHz to 960 MHz and from 1710 MHz to 2700 MHz, it also includes a frequency band from 617 MHz to 698 MHz, a frequency band from 3300 MHz to 5000 MHz, and a frequency band from 5150 MHz to 5850 MHz Regarding the low frequency band, it is difficult for the conventional antenna structure to cover the entire frequency band from 617 MHz to 960 MHz.

SUMMARY

An antenna structure according to the disclosure includes a first main radiator, a second main radiator, and a frequency adjustment radiator. The first main radiator is adapted to resonate in a first frequency band and a second frequency band, and includes a first section, a second section, a third section and a fourth section sequentially connected. The first section has a feed-in end, and the fourth section has a grounding end. The second section and the third section are connected in a bent manner. A first slit is provided between the second section and the third section and is adapted to adjust impedance matching of the second frequency band. The second main radiator extends from the feed-in end, and is adapted to resonate in a third frequency band and a fourth frequency band. The frequency adjustment radiator is connected to the third section of the first main radiator and is adapted to adjust a resonant frequency point of the first frequency band.

A communication device includes an antenna structure, a plurality of lumped elements, and a switch. The first frequency band includes a plurality of sub-intervals. The lumped elements are connected to a system grounding plane. A plurality of grounding paths are provided between the antenna structure and the system grounding plane, and the grounding paths respectively correspond to the sub-intervals of the first frequency band. One end of the switch is connected to the grounding end of the antenna structure, and another end of the switch is optionally connected to one of the lumped elements or not connected to the lumped elements, so that the antenna structure is connected to one of the grounding paths to resonate in one of the sub-intervals of the first frequency band.

Based on the above, the first main radiator of the antenna structure of the disclosure is adapted to resonate in the first frequency band and the second frequency band, and the first slit is provided between the second section and the third section, so as to adjust the impedance matching of the second frequency band. The second main radiator is adapted to resonate in the third frequency band and the fourth frequency band. The frequency adjustment radiator is adapted to adjust the resonant frequency point of the first frequency band. Therefore, the antenna structure of the disclosure is compatible with multiple frequency bands. Besides, by connecting one end of the switch to the grounding end of the antenna structure and optionally connecting the other end thereof to one of the lumped elements or not connecting the other end thereof to the lumped elements, the communication device according to the disclosure is able to choose among different grounding paths, so that the first frequency band can have a greater bandwidth coverage.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1A:
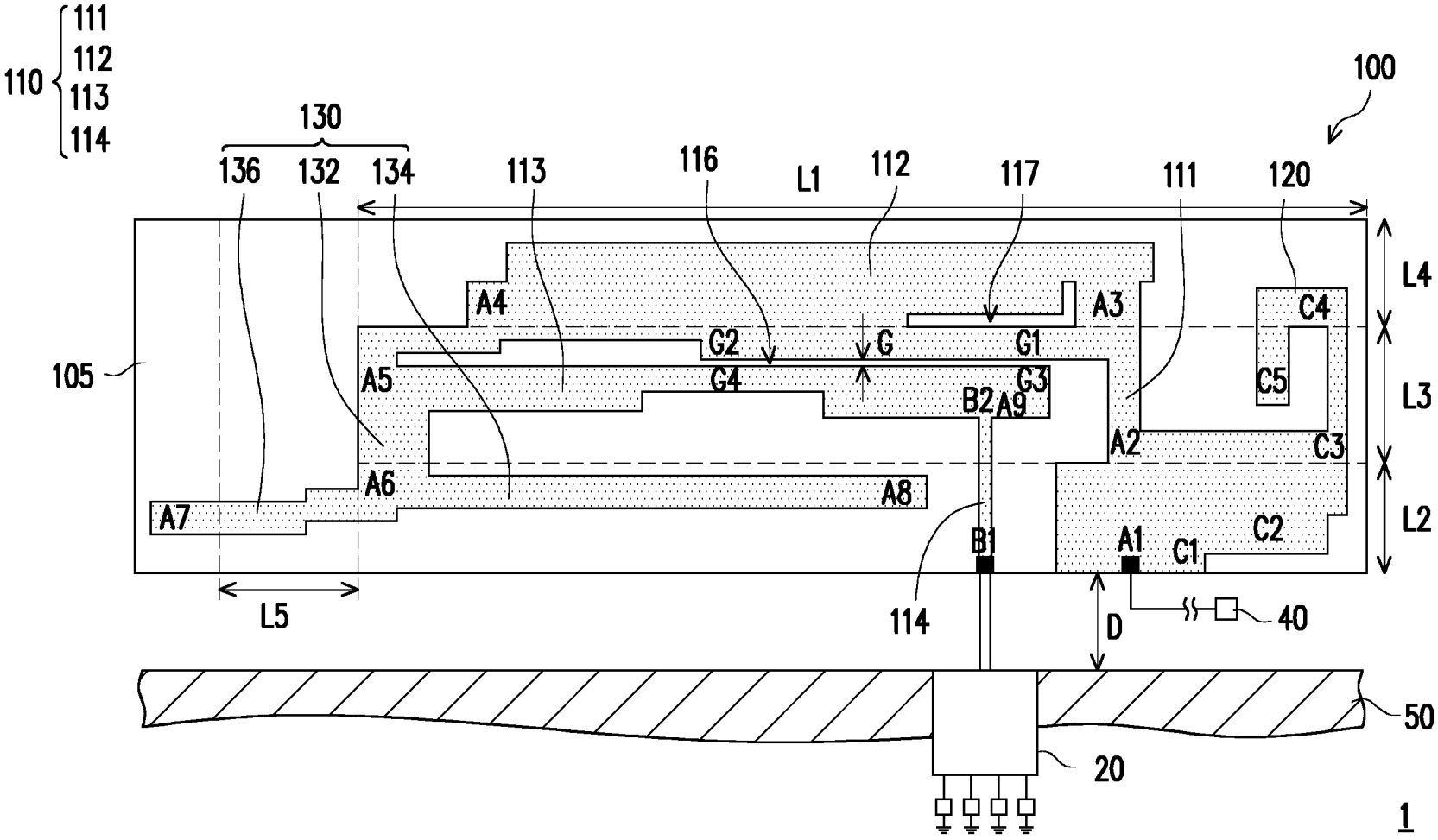
FIG. 1A is a schematic view illustrating an antenna structure of a communication device according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 1B:
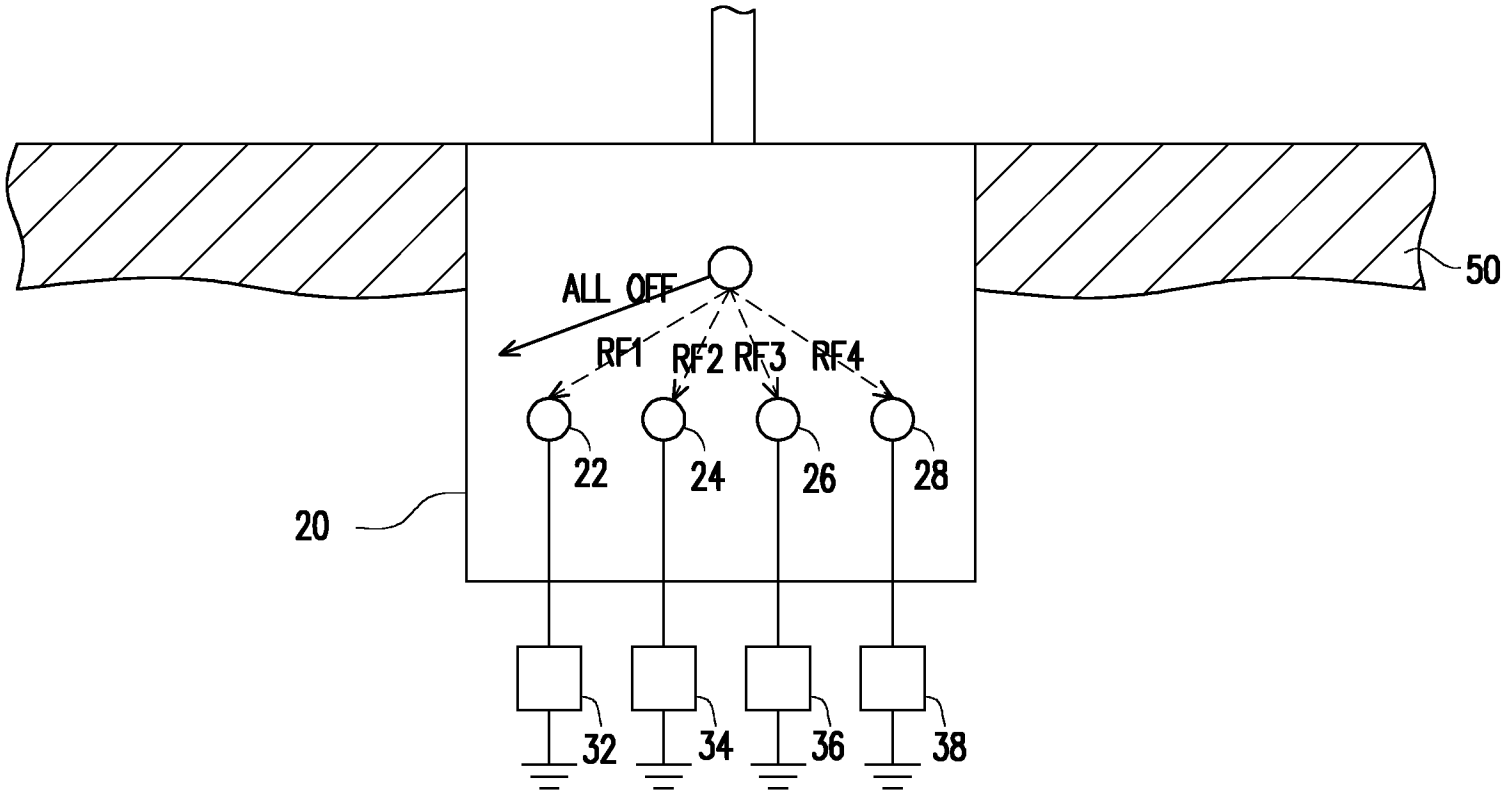
FIG. 1B is a schematic view illustrating a switch of the communication device of FIG. 1A.
Figure 2A:
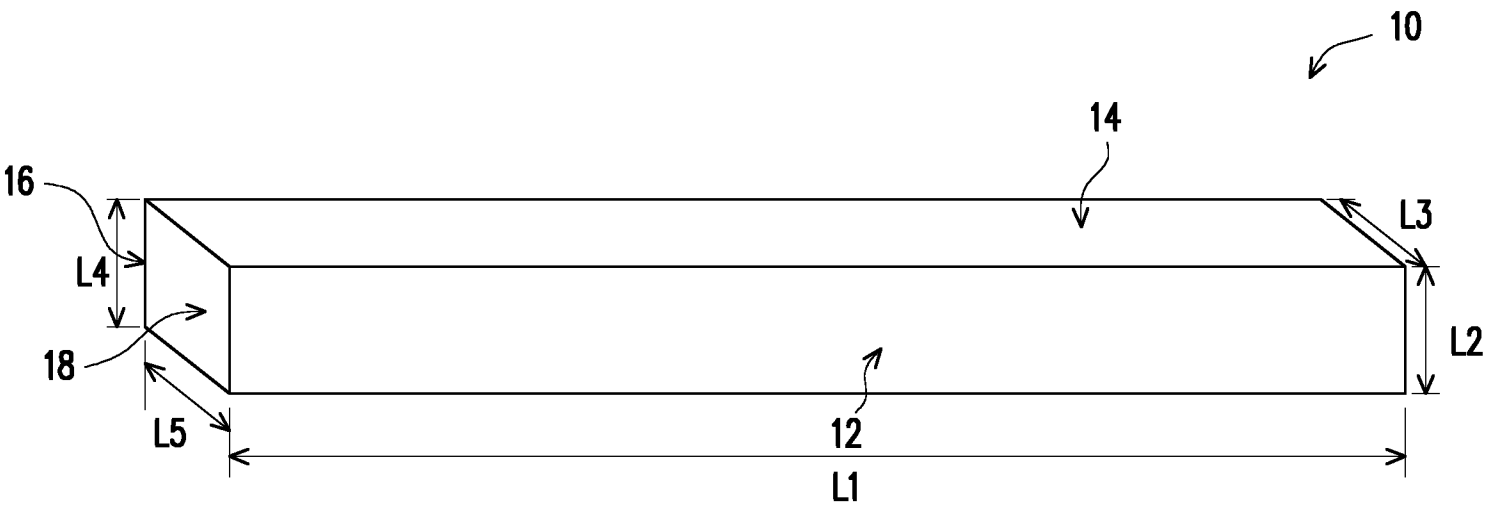
FIG. 2A is a schematic perspective view illustrating an insulating frame.

FIG. 1A is a schematic view illustrating an antenna structure of a communication device according to an embodiment of the disclosure. FIG. 1B is a schematic view illustrating a switch of the communication device of FIG. 1A. Referring to FIGS. 1A and 1B, a communication device 1 of this embodiment includes an antenna structure 100, a plurality of lumped elements 32, 34, 36, and 38 (FIG. 1B), and a switch 20. The antenna structure 100 is disposed on a substrate 105. The substrate 105, for example, is a flexible circuit board and is flexibly disposed on a structure such as an insulating frame 10 (FIG. 2A). However, the type of the substrate 105 is not limited thereto.

As shown in FIG. 1A, in the embodiment, the antenna structure 100 includes a first main radiator 110, a second main radiator 120, and a frequency adjustment radiator 130. The first main radiator 110 includes a first section 111 (locations A1, A2, and A3), a second section 112 (locations A3 and A4), a third section 113 (locations A5 and A9), and a fourth section 1114 (locations B2 and B1) sequentially connected in a bent manner.

More specifically, the first section 111 is connected to the second section 112 in a bent manner, the second section 112 is connected to the third section 113 in a bent manner, and the third section 113 is connected to the fourth section 114 in a bent manner. The first section 111 is located beside the fourth section 114, and the second section 112 is located beside the third section 113. The extending direction of the first section 111 is parallel to the extending direction of the fourth section 114, and the extending direction of the second section 112 is parallel to the extending direction of the third section 113.

In the embodiment, the first section 111 has a feed-in end (location A1), and the fourth section 114 has a grounding end (location B1). The feed-in end (location A1) is adapted to be electrically connected to a modem 40 or a positive signal end of a motherboard, and the grounding end (location B1) is adapted to be electrically connected to a negative signal end of the motherboard.

The first main radiator 110 is adapted to resonate in a first frequency band and a second frequency band. In the embodiment, the first frequency band is between 617 MHz and 960 MHz, and the second frequency band is between 1710 MHz and 2700 MHz. However, the first frequency band and the second frequency band are not limited thereto. In the embodiment, the length of the first main radiator 110 is between 0.4 times to 0.6 times of the wavelength of the first frequency band, such as 0.5 times of the wavelength.

More specifically, in the first main radiator 110, the first section 111 (locations A1, A2, and A3), the second section 112 (locations A3 and A4), the third section 113 (locations A5 and A9) and the fourth section 114 (locations B2 and B1) jointly form a loop antenna structure, and the path of the loop is 0.5 times of the wavelength of 900 MHz, and is about 160 millimeters. Of course, the length of the first main radiator 110 is not limited thereto.

In the embodiment, a slit 116 is provided between the second section 112 and the third section 113. The width of the first slit 116 is adapted to be adjusted to adjust the impedance matching and the position of the resonant frequency point of the second frequency band. In the embodiment, the width of the first slit 116 is between 0.3 millimeters and 0.5 millimeters. However, the width of the first slit 116 is not limited thereto. In addition, the width of the second section 112 is adapted to be adjusted to adjust the impedance matching of the second frequency band.

Moreover, in the embodiment, the second section 112 has a second slit 117 located inside. The second slit 117 may be adapted to adjust the impedance matching of the second frequency band. In other embodiments, the second slit 117 may be omitted from the second section 112.

In addition, the second main radiator 120 (locations C1, C2, C3, C4, and C5) extends from the feed-in end (location A1) and is adapted to resonate in a third frequency band and a fourth frequency band. In the embodiment, the third frequency band is between 3300 MHz and 5000 MHz, and the fourth frequency band is between 5150 MHz and 5850 MHz. However, the third frequency band and the fourth frequency band are not limited thereto.

As shown in FIG. 1A, the first section 111 of the first main radiator 110 is located between the fourth section 114 and the second main radiator 120, and the second main radiator 120 has a plurality of bends and does not exceed the first radiator in the width direction (up-down direction of FIG. 1A) of the substrate 105. In addition, in the embodiment, the impedance matching of the third frequency band and the fourth frequency band in the antenna structure 100 may be adjusted by adjusting a distance D between the parts of the second main radiator 120 at the locations C1 and C2 and a system grounding plane 50.

Besides, the frequency adjustment radiator 130 is connected to the third section 113 of the first main radiator 110 and is adapted to adjust a resonant frequency point of the first frequency band. More specifically, the frequency adjustment radiator 130 includes a fifth section 132 (locations A5 and A6), a sixth section 134 (locations A6 and A8), and a seventh section 136 (locations A6 and A7).

One end of the fifth section 132 is connected to turning points of the second section 112 and the third section 113, and the sixth section 134 and the seventh section 136 are respectively connected to the other end of the fifth section 132. In addition, the sixth section 134 and the seventh section 136 extend in opposite directions. Specifically, the sixth section 134 extends in a direction toward the fourth section 114, and the seventh section 136 extends in a direction away from the fourth section 114. In the embodiment, the sixth section 134 (locations A6 and A8) and the seventh section 136 (locations A6 and A7) may be configured to adjust the position of the resonant frequency point of the first frequency band.

As shown in FIG. 1B, in the embodiment, the lumped elements 32, 34, 36, and 38 are connected to the system grounding plane 50. One end of the switch 20 is connected to the grounding end (location B1) of the antenna structure 100, and the other end thereof is optionally connected to one of the lumped elements 32, 34, 36, and 38 or not connected to the lumped elements 32, 34, 36, and 38. In the embodiment, the lumped elements 32, 34, 36, and 38 include a capacitor or an inductor. However, the types of the lumped elements 32, 34, 36, and 38 are not limited thereto.

The grounding end (location B1) of the first main radiator 110 is connected to the switch 20 on a motherboard (not shown) to be switched to and connected to different contacts 22, 24, 26, and 28, so as to be connected to the corresponding lumped elements 32, 34, 36, and 38, thereby choosing different grounding paths (All OFF, RF1, RF3, RF4). These grounding paths (All OFF, RF1, RF3, RF4) respectively correspond to a plurality of sub-intervals in the first frequency band. When the antenna structure 100 is connected to the system grounding plane 50 via one of the grounding paths (All OFF, RF1, RF3, RF4), the antenna structure 100 is adapted to resonate in one of the sub-intervals (617 MHz to 698 MHz, 680 MHz to 800 MHz, 740 MHz to 860 MHz, 824 MHz to 960 MHz) of the first frequency band, so that the first frequency (low frequency) band can cover the bandwidth of 617 MHz to 960 MHz.

In the embodiment, the switch 20 is a one-to-four switch, for example. However, the switch 20 is not limited thereto. In other embodiments, the switch 20 may also be a one-to-two, one-to-three, one-to-five, or one-to-many switch.

Table 1 below is a control table corresponding to the one-to-four switch 20, which includes 16 switching configurations.

TABLE 1

| Configuration | Mode | D7 | D6 | D5 | D4 | D3 | D2 | D1 | D0 | Hexadecimal |
|---|---|---|---|---|---|---|---|---|---|---|
| 1 | All OFF (insulated) | 0 | 0 | 0 | 0 | 0 | 0 | 0 | 0 | 00 |
| 2 | grounded via parallel connection of RF1 | 1 | 1 | 1 | 0 | 0 | 0 | 0 | 1 | E1 |
| 3 | grounded via parallel connection of RF2 | 1 | 1 | 0 | 1 | 0 | 0 | 1 | 0 | D2 |
| 4 | grounded via parallel connection of RF1 and RF2 | 1 | 1 | 0 | 0 | 0 | 0 | 1 | 1 | C3 |
| 5 | grounded via parallel connection of RF3 | 1 | 0 | 1 | 1 | 0 | 1 | 0 | 0 | B4 |
| 6 | grounded via parallel connection of RF1 and RF3 | 1 | 0 | 1 | 0 | 0 | 1 | 0 | 1 | A5 |
| 7 | grounded via parallel connection of RF4 | 0 | 1 | 1 | 1 | 1 | 0 | 0 | 0 | 78 |
| 8 | grounded via parallel connection of RF1 and RF4 | 0 | 1 | 1 | 0 | 1 | 0 | 0 | 1 | 69 |
| 9 | All ON | 1 | 1 | 1 | 1 | 1 | 1 | 1 | 1 | Fill Factor (FF) |
| 10 | grounded via serial connection of RF1 | 0 | 0 | 0 | 1 | 1 | 1 | 1 | 0 | 1E |
| 11 | grounded via serial connection of RF2 | 0 | 0 | 1 | 0 | 1 | 1 | 0 | 1 | 2D |
| 12 | grounded via serial connection of RF1 and RF2 | 0 | 0 | 1 | 1 | 1 | 1 | 0 | 0 | 3C |
| 13 | grounded via serial connection of RF3 | 0 | 1 | 0 | 0 | 1 | 0 | 1 | 1 | 4B |
| 14 | grounded via serial connection of RF1 and RF3 | 0 | 1 | 0 | 1 | 1 | 0 | 1 | 0 | 5A |
| 15 | grounded via serial connection of RF4 | 1 | 0 | 0 | 0 | 0 | 1 | 1 | 1 | 87 |
| 16 | grounded via serial connection of RF1 and RF4 | 1 | 0 | 0 | 1 | 0 | 1 | 1 | 0 | 96 |

In the embodiment, by only choosing some of the configurations (i.e., adopting only All OFF, grounded via parallel connection of RF1, grounded via parallel connection of RF3, and grounded via parallel connection of RF4 modes), the first frequency band is able to exhibit a favorable coverage.

More specifically, when the switch 20 is not operated (i.e., being open circuit as "All OFF"), the resonant frequency band thereof is the fourth sub-interval (band 4) of the first frequency band, i.e., 824 MHz to 960 MHz.

When the switch 20 chooses the RF1 path and is connected to the contact 22 (grounded via parallel connection of RF1), it is grounded via parallel connection with the lumped element 32 (e.g., an inductor of 1.6 nH), and the resonant frequency band thereof is the first sub-interval (band 1) of the first frequency band, i.e., 617 MHz to 698 MHz.

When the switch 20 chooses the RF3 path and is connected to the contact 26 (grounded via parallel connection of RF3), it is grounded via parallel connection with the lumped element 36 (e.g., a capacitor of 3.9 pF), and the resonant frequency band thereof is the second sub-interval (band 2) of the first frequency band, i.e., 680 MHz to 800 MHz.

When the switch 20 chooses the RF4 path and is connected to the contact 28 (grounded via parallel connection of RF4), it is grounded via parallel connection with the lumped element 38 (e.g., a capacitor of 1 pF), and the resonant frequency band thereof is the third sub-interval (band 3) of the first frequency band, i.e., 740 MHz to 860 MHz. Of course, the types and the number of the lumped elements 32, 34, 36, and 38 are not limited thereto.

It should be noted that, in the embodiment, the antenna structure 100 is adapted to be disposed on an insulating frame 10 to reduce the volume of the communication device 1 and has good antenna frequency. FIG. 2A is a schematic perspective view illustrating an insulating frame. FIGS. 2B to 2E are schematic views illustrating the antenna structure 100 of FIG. 1A disposed on different surfaces of the insulating frame 10. In some embodiments, the insulating frame 10 is made of a plastic material. However, the disclosure is not limited thereto.

Figure 2B:
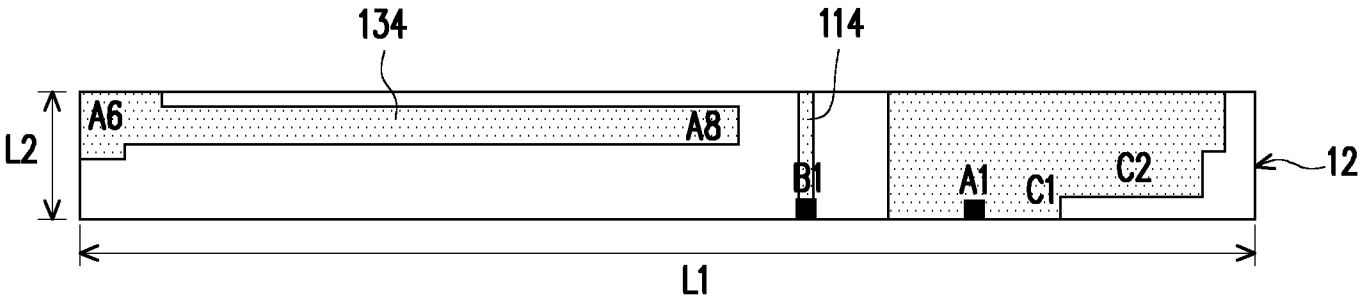
FIGS. 2B to 2E are schematic views illustrating the antenna structure of FIG. 1A disposed on different surfaces of the insulating frame.

Referring to FIGS. 1A and 2A to 2E, the insulating frame 10 is, for example, a rectangular body, and has a first long side surface 12, a second long side surface 14, a third long side surface 16, and a short side surface 18. As shown in FIG. 2B, a portion (location A1) of the first section 111 and a portion (location B1) of the fourth section 114 of the first main radiator 110, a portion (locations C1 and C2) of the second main radiator 120, and a portion (locations A6 and A8) of the frequency adjustment radiator 130 are distributed on the first long side surface 12 of the insulating frame 10.

Figure 2C:
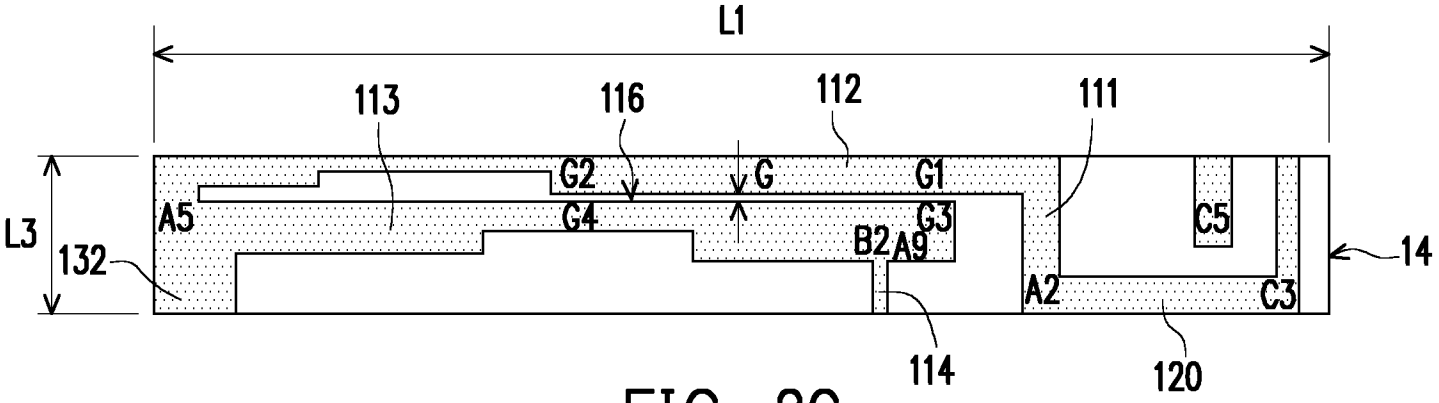

As shown in FIG. 2C, the remaining portion (location A2) of the first section 111, a portion (locations A2 and A5) of the second section 112, the entire third section 113 (locations A5 and A9), and the remaining portion of the fourth section 114 of the first main radiator 110, another portion (locations C3 and C5) of the second main radiator 120, and another portion (location A5) of the frequency adjustment radiator 130 are distributed on the second long side surface 14 of the insulating frame 10.

Figure 2D:
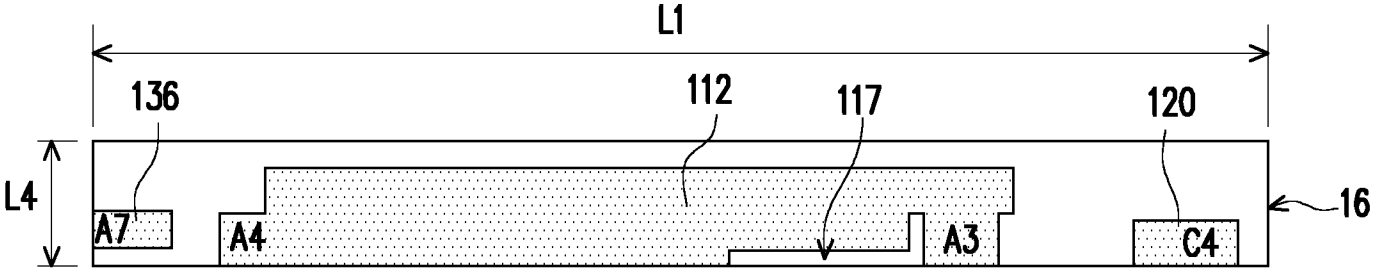
Figure 2E:
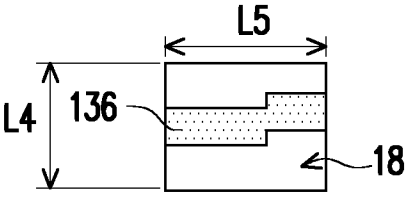

As shown in FIG. 2D, the remaining portion (locations A3 and A4) of the second section 112 of the first main radiator 110, the remaining portion (location C4) of the second main radiator 120, and yet another portion (location A7) of the frequency adjustment radiator 130 are distributed on the third long side surface 16 of the insulating frame 10. In addition, as shown in FIG. 2E, the remaining portion of the frequency adjustment radiator 130 is located on the short side surface 18 of the insulating frame 10.

A length L1 of the insulating frame 10 is between 70 millimeters and 90 millimeters, such as 80 millimeters. Widths L3 and L5 are between 8 millimeters and 15 millimeters, such as 12 millimeters. Heights L2 and L4 are between 8 millimeters and 15 millimeters, such as 10 millimeters. Of course, the disclosure is not limited to the sizes above. In the embodiment, the first main radiator 110, the second main radiator 120, and the frequency adjustment radiator 130 may be optionally distributed on the first long side surface 12, the second long side surface 14, the third long side surface 16, and the short side surface 18 of the insulating frame 10, so as to reduce the volume of the communication device 1.

Figure 3:
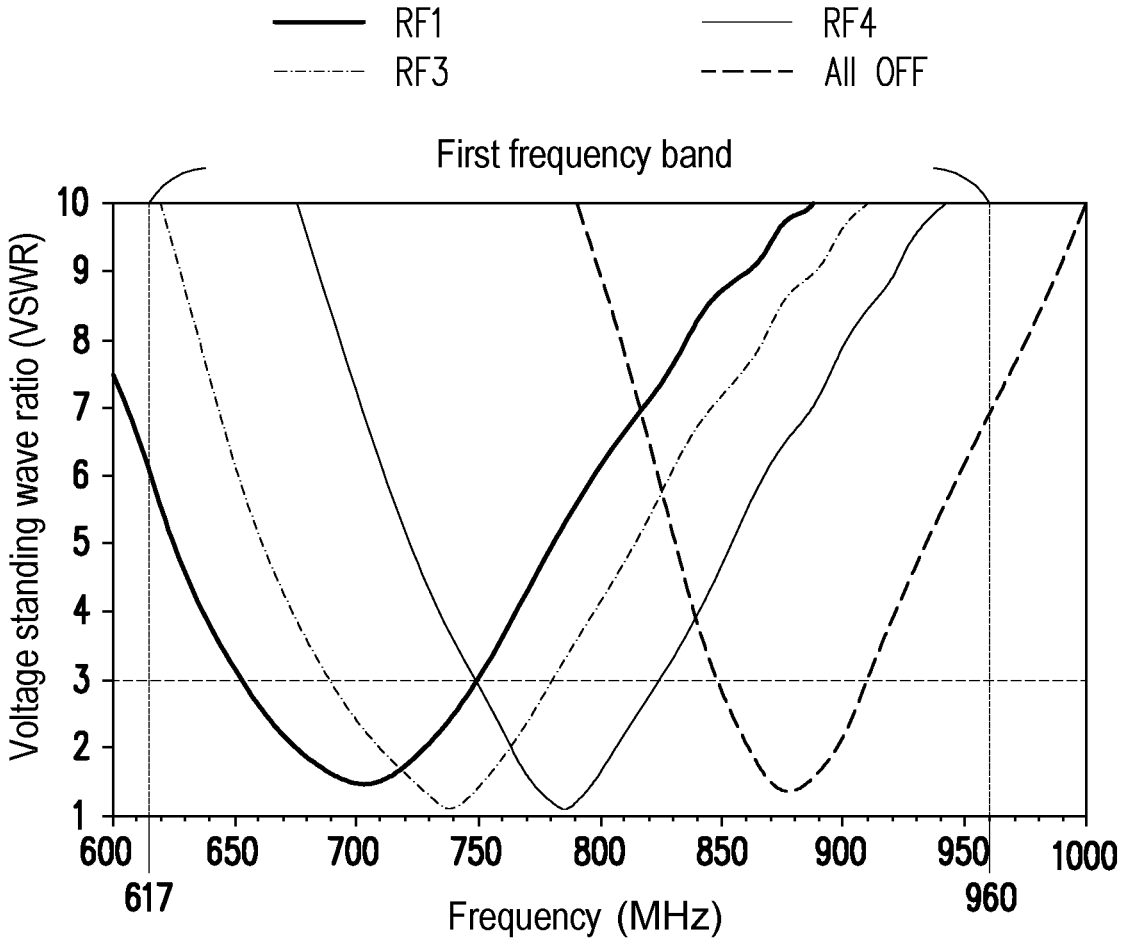
FIG. 3 is a diagram illustrating a relationship between frequency (600 MHz to 1000 MHz) and voltage standing wave ratio of the communication device of FIG. 1A.

FIG. 3 is a diagram illustrating a relationship between frequency (600 MHz to 1000 MHz) and voltage standing wave ratio of the communication device of FIG. 1A. Referring to FIG. 3, in the embodiment, when the switch 20 is switched to different grounding paths (RF1, RF3, RF4, All OFF), except that the voltage standing wave ratios of the frequencies at around 617 MHz and 960 MHz are about equal to or less than 6, the voltage standing wave ratios of the first sub-interval (band 1, 617 MHz to 698 MHz), the second sub-interval (band 2, 680 MHz to 800 MHz), the third sub-interval (band 3, 740 MHz to 860 MHz), and the fourth sub-interval (band 4, 824 MHz to 960 MHz) of the first frequency band are generally equal to or lower than 3, so the bandwidth performance is favorable.

Figure 4:
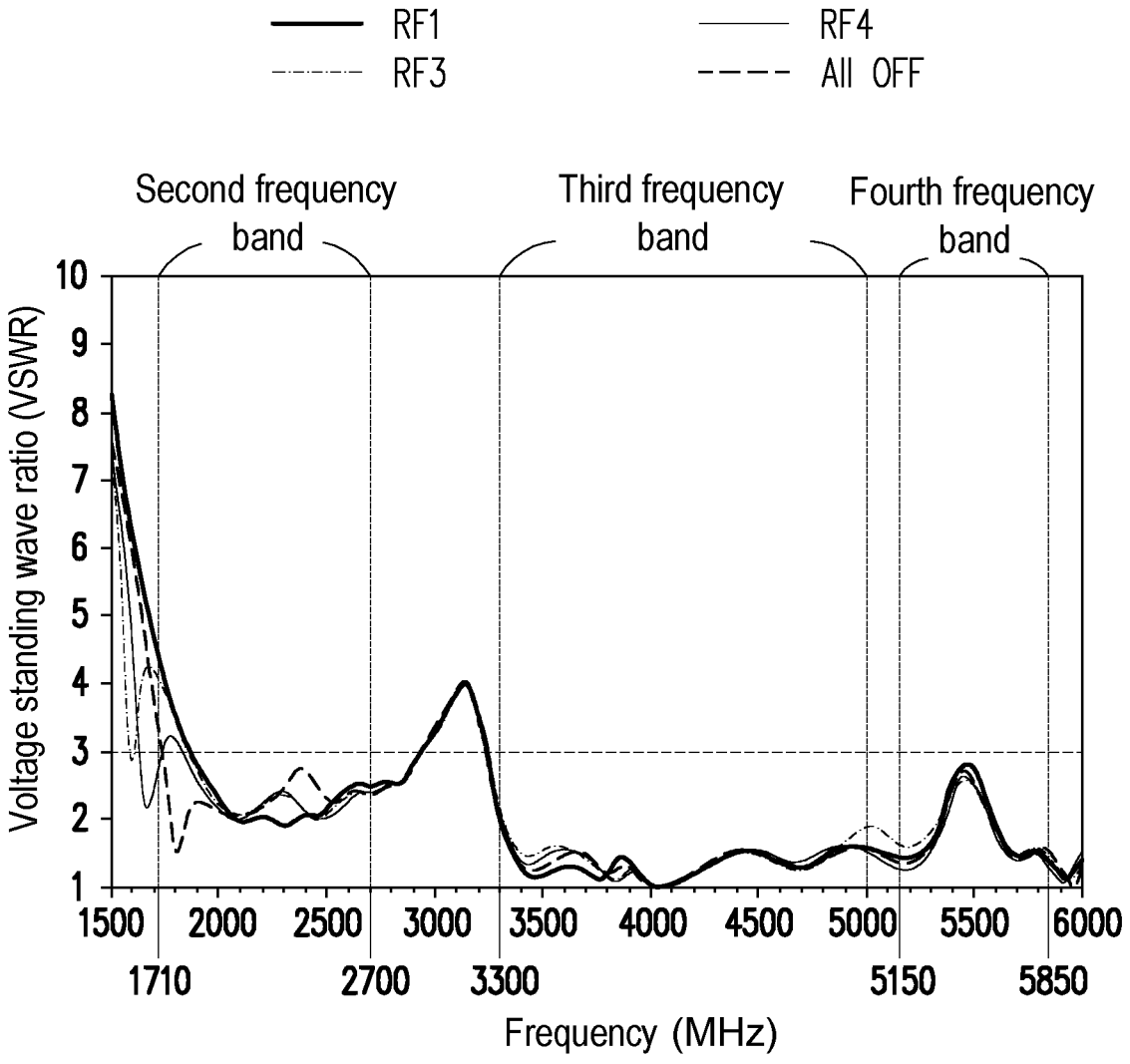
FIG. 4 is a diagram illustrating a relationship between frequency (1500 MHz to 6000 MHz) and voltage standing wave ratio of the communication device of FIG. 1A.

In addition, FIG. 4 is a diagram illustrating a relationship between frequency (1500 MHz to 6000 MHz) and voltage standing wave ratio of the communication device of FIG. 1A. Referring to FIG. 4, when the switch 20 is switched to different grounding paths (RF1, RF3, RF4, All OFF), the values for the third frequency band (3300 MHz to 5000 MHz) and the fourth frequency band (5150 MHz to 5850 MHz) are kept equal to or lower than 3. Therefore, when a low frequency band (the first frequency band) is switched to different grounding paths, the properties of high frequency bands (the third frequency band to the fourth frequency band) are not affected, and the performance is still favorable.

That is, in the embodiment, the communication device 1 may be grounded via different paths, such as All OFF (insulated), grounded via parallel connection of RF1, grounded via parallel connection of RF3, grounded via parallel connection of RF4, etc., to switch among the bands of the first sub-interval (band 1, 617 MHz to 698 MHz), the second sub-interval (band 2, 680 MHz to 800 MHz), the third sub-interval (band 3, 740 MHz to 860 MHz), and the fourth sub-interval (band 4, 824 MHz to 960 MHz) in the first frequency band, so that the first frequency band is compatible with the bandwidth from 617 MHz to 960 MHz. In this way, the first frequency band is a wide band, and the third frequency band and the fourth frequency band (high frequency bands) are not affected by the switching. Therefore, frequency shifting or impedance mismatching does not occur in the third frequency band and the fourth frequency band (high frequency bands).

Figure 5:
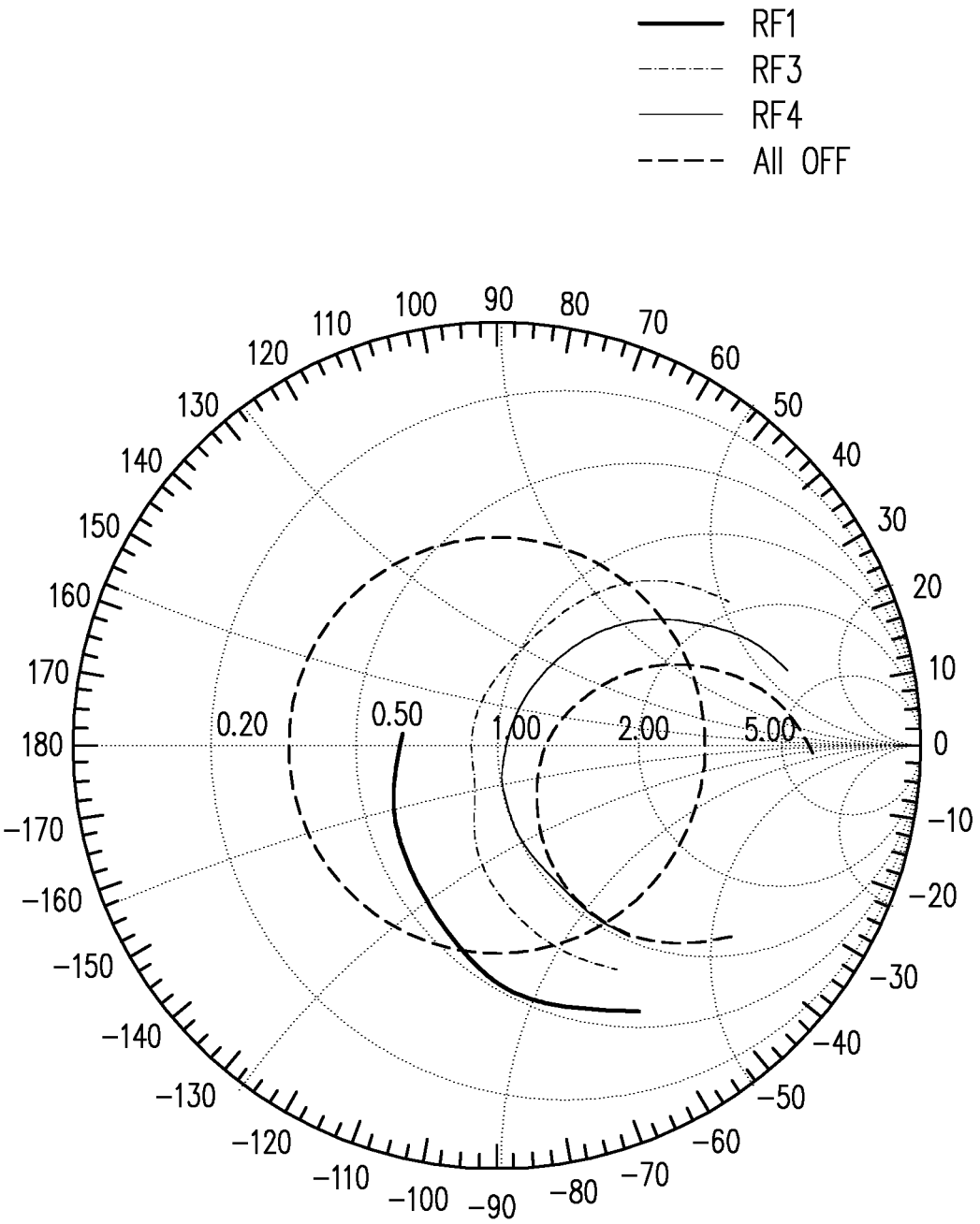
FIG. 5 is a Smith chart of a first frequency band (617 MHz to 960 MHz) of the communication device of FIG. 1A.

FIG. 5 is a Smith chart of the first frequency band (617 MHz to 960 MHz) of the communication device of FIG. 1A. Referring to FIG. 5, as shown in the Smith chart, by connecting different inductors or capacitors in parallel, the circles of variations in the Smith chart all indicate VSWR values equal to or less than 3, so the performance is favorable.

Figure 6:
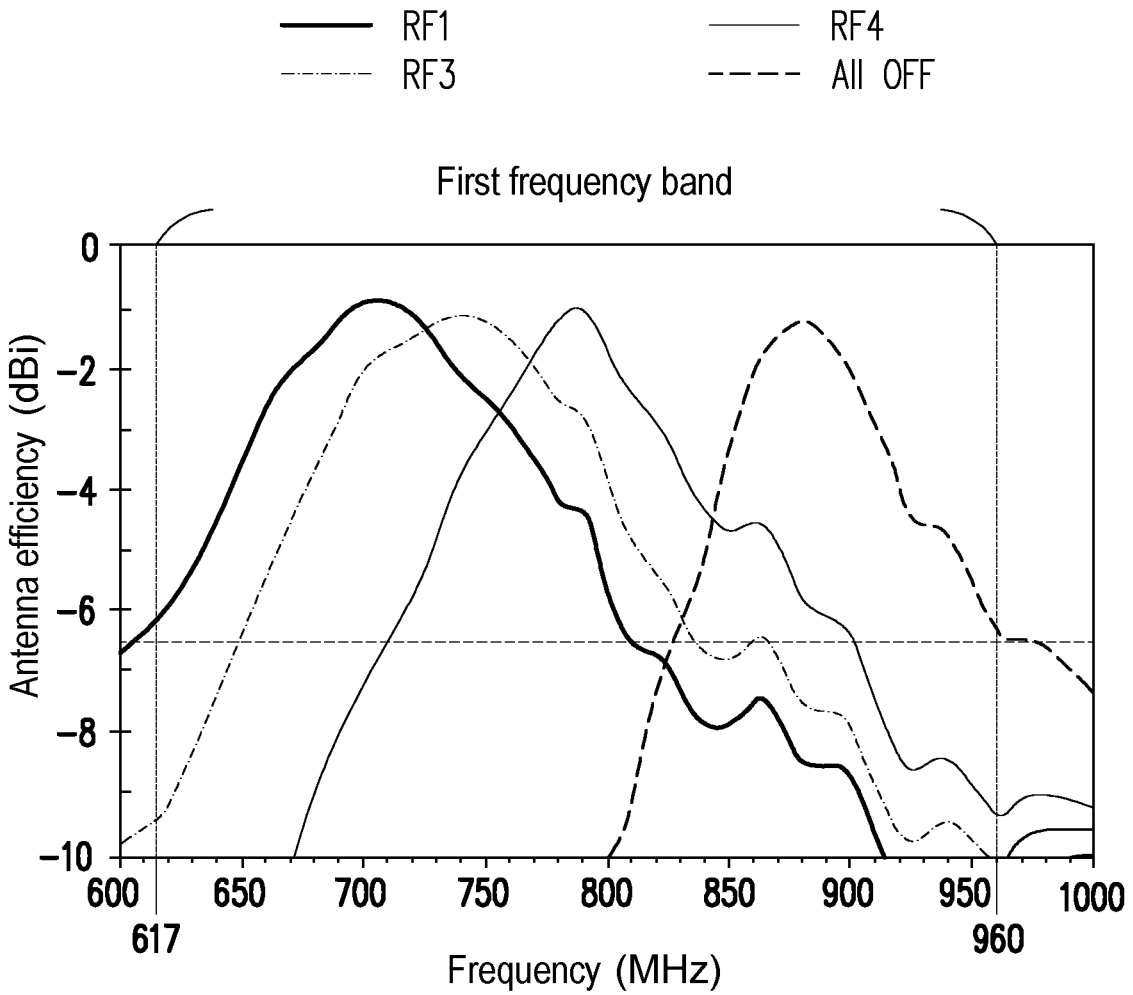
FIG. 6 is a diagram illustrating a relationship between frequency (600 MHz to 1000 MHz) and antenna efficiency of the communication device of FIG. 1A.

FIG. 6 is a diagram illustrating a relationship between frequency (600 MHz to 1000 MHz) and antenna efficiency of the communication device of FIG. 1A. Referring to FIG. 6, in the embodiment, when the switch 20 is switched to different grounding paths (RF1, RF3, RF4, All OFF), the antenna efficiencies of the first sub-interval (band 1, 617 MHz to 698 MHz), the second sub-interval (band 2, 680 MHz to 800 MHz), the third sub-interval (band 3, 740 MHz to 860 MHz), and the fourth sub-interval (band 4, 824 MHz to 960 MHz) are within −1.0 dBi to −6.4 dBi and all equal to or greater than −6.5 dBi, so the antenna efficiency is favorable.

Figure 7:
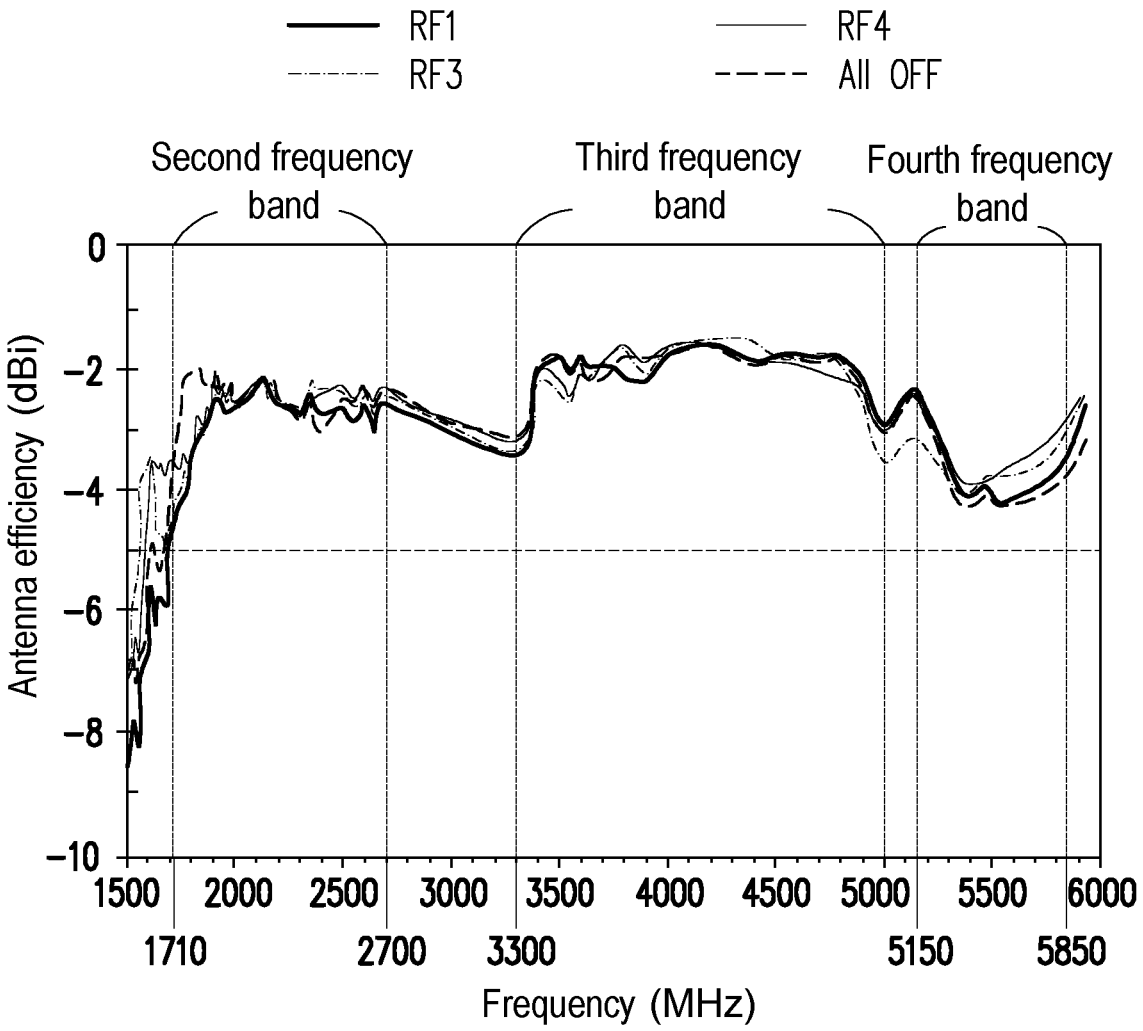
FIG. 7 is a diagram illustrating a relationship between frequency (1500 MHz to 6000 MHz) and antenna efficiency of the communication device of FIG. 1A.

FIG. 7 is a diagram illustrating a relationship between frequency (1500 MHz to 6000 MHz) and antenna efficiency of the communication device of FIG. 1A. Referring to FIG. 7, in the embodiment, when the switch 20 is switched to different grounding paths (RF1, RF3, RF4, All OFF), the antenna efficiencies of the second frequency band (1710 MHz to 2700 MHz) are within −1.9 dBi to −4.9 dBi, the antenna efficiencies of the third frequency band (3300 MHz to 5000 MHz) are within −1.5 dBi to −3.7 dBi, and the antenna efficiencies of the fourth frequency band (5150 MHz to 5850 MHz) are within −3.3 dBi to −4.5 dBi. The antenna efficiency values are all greater than −5 dBi, which exhibits favorable efficiency performance as a Sub-6G LTE wideband antenna for 5G communication.

In view of the foregoing, the first main radiator of the antenna structure of the disclosure is adapted to resonate in the first frequency band and the second frequency band, and the first slit is present between the second section and the third section, so as to adjust the impedance matching of the second frequency band. The second main radiator is adapted to resonate in the third frequency band and the fourth frequency band. The frequency adjustment radiator is adapted to adjust the resonant frequency point of the first frequency band. Therefore, the antenna structure of the disclosure is compatible with multiple frequency bands. Besides, by connecting one end of the switch to the grounding end of the antenna structure and optionally connecting the other end thereof to one of the lumped elements or not connecting the other end thereof to the lumped elements, the communication device according to the disclosure is able to choose among different grounding paths, so that the first frequency band can have a greater coverage.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. An antenna structure, comprising:

a first main radiator, adapted to resonate in a first frequency band and a second frequency band, and comprising a first section, a second section, a third section and a fourth section sequentially connected, wherein the first section has a feed-in end, the fourth section has a grounding end, the second section and the third section are connected in a bent manner, a first slit is provided between the second section and the third section and the first slit is adapted to adjust impedance matching of the second frequency band;

a second main radiator, extending from the feed-in end, and adapted to resonate in a third frequency band and a fourth frequency band; and a frequency adjustment radiator, connected to the third section of the first main radiator and adapted to adjust a resonant frequency point of the first frequency band, wherein the frequency adjustment radiator comprises a fifth section, a sixth section, and a seventh section, an end of the fifth section is connected to turning points of the second section and the third section, the sixth section and the seventh section are respectively connected to another end of the fifth section, and the sixth section and the seventh section extend in opposite directions.

2. The antenna structure as claimed in claim 1, wherein the first frequency band is between 617 MHz and 960 MHz, the second frequency band is between 1710 MHz and 2700 MHz, the third frequency band is between 3300 MHz and 5000 MHz, and the fourth frequency band is between 5150 MHz and 5850 MHz.

3. The antenna structure as claimed in claim 1, wherein a length of the first main radiator is between 0.4 times and 0.6 times of a wavelength of the first frequency band.

4. The antenna structure as claimed in claim 1, wherein the first section is connected to the second section in a bent manner, the third section is connected to the fourth section in a bent manner, the first section is located beside the fourth section, an extending direction of the first section is parallel to an extending direction of the fourth section, and an extending direction of the second section is parallel to an extending direction of the third section.

5. The antenna structure as claimed in claim 1, wherein a width of the first slit is between 0.3 millimeters and 0.5 millimeters.

6. The antenna structure as claimed in claim 1, wherein the sixth section extends in a direction toward the fourth section, and the seventh section extends in a direction away from the fourth section.

7. The antenna structure as claimed in claim 1, wherein the first section is located between the fourth section and the second main radiator, and the second main radiator has a plurality of bends.

8. The antenna structure as claimed in claim 1, further comprising an insulating frame having a first long side surface, a second long side surface, a third long side surface, and a short side surface, wherein a portion of the first section and a portion of the fourth section of the first main radiator, a portion of the second main radiator, and a portion of the frequency adjustment radiator are distributed on the first long side surface of the insulating frame, a remaining portion of the first section, a portion of the second section, the entire third section, and a remaining portion of the fourth section of the first main radiator, another portion of the second main radiator, and another portion of the frequency adjustment radiator are distributed on the second long side surface of the insulating frame, a remaining portion of the second section of the first main radiator, a remaining portion of the second main radiator, and yet another portion of the frequency adjustment radiator are distributed on the third long side surface of the insulating frame, and a remaining portion of the frequency adjustment radiator is distributed on the short side surface of the insulating frame.

9. The antenna structure as claimed in claim 8, wherein a length of the insulating frame is between 70 millimeters and 90 millimeters, a width of the insulating frame is between 8 millimeters and 15 millimeters, and a height of the insulating frame is between 8 millimeters and 15 millimeters.

10. A communication device, comprising:

an antenna structure, comprising a first main radiator, adapted to resonate in a first frequency band and a second frequency band, and comprising a first section, a second section, a third section and a fourth section sequentially connected, wherein the first section has a feed-in end, the fourth section has a grounding end, the second section and the third section are connected in a bent manner, a first slit is provided between the second section and the third section and the first slit is adapted to adjust impedance matching of the second frequency band, wherein the first frequency band comprises a plurality of sub-intervals;

a second main radiator, extending from the feed-in end, and adapted to resonate in a third frequency band and a fourth frequency band; and a frequency adjustment radiator, connected to the third section of the first main radiator and adapted to adjust a resonant frequency point of the first frequency band;

a plurality of lumped elements, connected to a system grounding plane, wherein a plurality of grounding paths are provided between the antenna structure and the system grounding plane, and the grounding paths respectively correspond to the sub-intervals of the first frequency band; and a switch, wherein one end of the switch is connected to the grounding end of the antenna structure, and another end of the switch is optionally connected to one of the lumped elements or not connected to the lumped elements, so that the antenna structure is connected to one of the grounding paths to resonate in one of the sub-intervals of the first frequency band.

11. The communication device as claimed in claim 10, wherein the lumped elements comprise a capacitor or an inductor.

12. The communication device as claimed in claim 10, wherein the lumped element comprises a first lumped element, a second lumped element, and a third lumped element, the grounding paths comprise four grounding paths, the sub-intervals of the first frequency band comprise a first sub-interval, a second sub-interval, a third sub-interval, and a fourth sub-interval, the antenna structure is adapted to resonate in the first sub-interval of the first frequency band when the switch is connected to the first lumped element, the antenna structure is adapted to resonate in the second sub-interval of the first frequency band when the switch is connected to the second lumped element, the antenna structure is adapted to resonate in the third sub-interval of the first frequency band when the switch is connected to the third lumped element, and the antenna structure is adapted to resonate in the fourth sub-interval of the first frequency band when the switch is not connected to the lumped elements.

13. The communication device as claimed in claim 12, wherein the first sub-interval is between 617 MHz and 698 MHz, the second sub-interval is between 680 MHz and 800 MHz, the third sub-interval is between 740 MHz and 860 MHz, and the fourth sub-interval is between 824 MHz and 960 MHz.

* * * * *